US008670586B1

(12) United States Patent
Boyle et al.

(10) Patent No.: US 8,670,586 B1
(45) Date of Patent: Mar. 11, 2014

(54) COMBINING AND WATERPROOFING HEADPHONE PORT EXITS

(75) Inventors: Stephen D. Boyle, Newton, MA (US); Kenneth D. Gagnon, Westminster, MA (US); Jonathan A. Knudsen, Pawtucket, RI (US); William Tice, Nashua, NH (US); Kevin J. Winter, Hingham, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 13/606,149

(22) Filed: Sep. 7, 2012

(51) Int. Cl.
*H04R 1/10* (2006.01)
*H04R 5/033* (2006.01)

(52) U.S. Cl.
CPC ..... *H04R 1/1008* (2013.01); *H04R 5/033* (2013.01)
USPC ..... 381/370; 381/371; 381/189

(58) Field of Classification Search
USPC ..... 381/189, 345, 346, 347, 348, 370, 371, 381/374, 376, 380; 181/148, 149, 198; 379/430; 455/575.2
See application file for complete search history.

(56) References Cited

U.S. PATENT DOCUMENTS

| | | | | |
|---|---|---|---|---|
| 1,893,474 | A | | 1/1933 | Lieber |
| 2,538,419 | A | * | 1/1951 | Huston et al. ..... 379/437 |
| 4,058,688 | A | | 11/1977 | Nishimura et al. |
| 4,677,679 | A | | 6/1987 | Killion |
| 4,742,887 | A | | 5/1988 | Yamagishi |
| 4,870,688 | A | | 9/1989 | Voroba et al. |
| 4,878,560 | A | | 11/1989 | Scott |
| 4,880,076 | A | | 11/1989 | Ahlberg et al. |
| 4,917,504 | A | | 4/1990 | Scott et al. |
| 4,987,597 | A | | 1/1991 | Haertl |
| 5,327,507 | A | | 7/1994 | Suzuki |
| 5,712,453 | A | | 1/1998 | Bungardt et al. |
| 5,761,298 | A | | 6/1998 | Davis et al. |

(Continued)

FOREIGN PATENT DOCUMENTS

| | | | |
|---|---|---|---|
| DE | 102009038372 | A1 | 3/2011 |
| EP | 0825796 | A2 | 2/1998 |

(Continued)

OTHER PUBLICATIONS htlp://www.sonystyle.com/isbinIINTERSHOP.enfinity/eCS/Store/en/-/USD/SY__DisplayProductInformatIonStartCategoryName=pa__Headphones-FontopiaEarbud&ProductSKU=MDRED21LP&TabName=specs&var2=, Sony MDR ED21LP, printed Mar. 2006.

(Continued)

*Primary Examiner* — Tuan D Nguyen

(57) ABSTRACT

A plate attached to the back shell of an earphone includes an exit cavity corresponding in dimension to and aligned with a first opening through the back shell. A channel in the bottom surface of the plate begins at a point aligned with a second opening through the back shell and ends at an aperture through a side wall of the exit cavity. The channel and the outer surface of the back shell together form a reactive acoustic port from a back cavity enclosed by the back shell to the exit cavity, the first opening through the shell forms a resistive acoustic port from the back cavity to the exit cavity, and the exit cavity couples the reactive acoustic port and the resistive acoustic port to free space without introducing additional acoustic impedance. In some examples, a water-resistant screen covers the upper aperture of the exit cavity.

25 Claims, 7 Drawing Sheets

(56) References Cited

U.S. PATENT DOCUMENTS

| | | | | |
|---|---|---|---|---|
| 5,781,638 | A | 7/1998 | Hosaka et al. | |
| 5,887,070 | A | 3/1999 | Iseberg et al. | |
| 6,021,195 | A | 2/2000 | Brawne et al. | |
| 6,134,336 | A | 10/2000 | Clark | |
| RE37,398 | E * | 10/2001 | Nageno | 381/371 |
| 6,320,960 | B1 | 11/2001 | Lathrop, III et al. | |
| 6,412,593 | B1 | 7/2002 | Jones | |
| D478,991 | S | 8/2003 | Dyer et al. | |
| RE38,351 | E | 12/2003 | Iseberg et al. | |
| 6,688,421 | B2 | 2/2004 | Dyer et al. | |
| 6,735,316 | B1 | 5/2004 | Wurtz | |
| 6,831,984 | B2 | 12/2004 | Sapiejewski | |
| 6,922,476 | B2 | 7/2005 | Nassimi | |
| 7,916,888 | B2 | 3/2011 | Sapiejewski et al. | |
| 2001/0043707 | A1 | 11/2001 | Leedom | |
| 2003/0152244 | A1 | 8/2003 | Dobras et al. | |
| 2004/0042625 | A1 | 3/2004 | Brown | |
| 2004/0202343 | A1 | 10/2004 | Rye et al. | |
| 2005/0147269 | A1 | 7/2005 | Oliveira et al. | |
| 2011/0058704 | A1 | 3/2011 | Harlow et al. | |
| 2012/0160543 | A1 | 6/2012 | Nakanishi et al. | |
| 2012/0269375 | A1 | 10/2012 | Tan et al. | |

FOREIGN PATENT DOCUMENTS

| | | | |
|---|---|---|---|
| EP | 1058479 | A2 | 12/2000 |
| EP | 1809069 | A1 | 7/2007 |
| EP | 1874080 | A2 | 1/2008 |
| GB | 2408405 | A | 5/2005 |
| JP | 07-115695 | A | 5/1995 |
| JP | 07-170591 | A | 7/1995 |
| JP | 08-172691 | A | 7/1996 |
| JP | 10-066181 | A | 3/1998 |
| JP | 11-308685 | A | 11/1999 |
| WO | 9931935 | A1 | 6/1999 |
| WO | 0124579 | | 4/2001 |
| WO | 03069951 | A1 | 8/2003 |
| WO | 2007031340 | A2 | 3/2007 |
| WO | 2007089845 | A2 | 8/2007 |
| WO | 2011015236 | A1 | 2/2011 |

OTHER PUBLICATIONS http://emedia.leeward.hawaii.edu/Frary/sony_mdr-nc1 0_review.htm, SonyMDR-NC10 Noise Canceling Stereo Headphones, printed Jun. 18, 2002* updated Jun. 27, 2003.

http://www.plantronics.com/media/media-resources/literature/user_guides/discovery640_ug_an_e.pdf;jsessionid=XIFCOZVIKEJBOCQBGNUCFFAKAEZWSIVO, Plantronics Discovery 640 User Guide Printed Jun. 2005, pp. 1-18.

http://www.plantronics.com/media/media_resources/literature/cordless_mobile/discovery640_en.pdf;jsessionid=XIFCOZVIKEJBOCQBGNUCFFAKAEZWSIVO, Plantronics Discovery 640 Bluetooth Headset, printed Jul. 2005.

http://www.shure.com/PersonalAudio/Products/Earphones/ESeries/us_pa_E500_pth_content, E500PTH Sound Isolating Earphones, Triple Hi-Definition Drivers, printed Jun. 26, 2006.

International Search Report and Written Opinion dated Jun. 18, 2008 from International Application No. PCT/US2007/088805.

International Report on Patentability dated Jul. 9, 2009 for PCT/US2007/088805.

Office Action dated Dec. 21, 2009 for EP 07111157.9-1224.

EP Search Report dated Dec. 10, 2008 for EP Appl. No. 07111157.9-1224 / 1874080.

International Search Report and Written Opinion dated Feb. 6, 2012 for PCT/US2011/047728.

Japan Office Action dated Feb. 23, 2012 for application No. 2007-172828.

Chinese Office Action dated Mar. 30, 2012 for Application No. 200710126963.6.

International Search Report and Written Opinion dated Nov. 13, 2013 for International Application No. PCT/US2013/057508.

* cited by examiner

COMBINING AND WATERPROOFING HEADPHONE PORT EXITS

CROSS-REFERENCE TO RELATED APPLICATIONS

This application is related to U.S. patent application Ser. Nos. 12/857,462, filed Aug. 16, 2010, and 13/041,854, filed Mar. 7, 2011, which are a continuation-in-part and a continuation, respectively, of U.S. Pat. No. 7,916,888. The entire contents of each are hereby incorporated by reference.

BACKGROUND

This disclosure relates to exits for headphone ports. U.S. Pat. No. 7,916,888 describes an in-ear headphone design in which two acoustic ports, one acoustically reactive and one acoustically resistive, are provided to couple the cavity enclosing the back side of an electroacoustic transducer to the environment, as shown in FIG. 7. That patent described a particular method of constructing the headphone, as shown in FIG. 8. In that design, a first region 12 of the earphone 10 includes a rear chamber 14 and a front chamber 16 defined by shells 15 and 17, respectively, on either side of an electroacoustic transducer, or driver, 18. The front chamber 16 extends through a second region 20 to the entrance to the ear canal, and in some embodiments into the ear canal, through a cushion 22 and ends at an acoustic resistance element 24. An acoustic resistance element is something that dissipates a proportion of acoustic energy that impinges on or passes through it. The rear chamber 14 is sealed around the back side of the driver 18 by the shell 15. The rear chamber 14 is acoustically coupled to the environment through a reactive element, such as a reactive port (also referred to as a mass port) 26, and a resistive element, which may also be formed as a resistive port 28. U.S. Pat. No. 6,831,984 describes the use of parallel reactive and resistive ports in a headphone device, and is incorporated here by reference. Although we refer to acoustic ports as reactive or resistive, in practice any acoustic port will have both reactive and resistive effects. The term used to describe a given acoustic port indicates which effect is dominant.

A reactive port like the port 26 is, for example, a tube-shaped opening in what may otherwise be a sealed acoustic chamber, in this case rear chamber 14. In the example of FIG. 8, the reactive port 26 is defined by voids in an inner spacer 30, the shell 15, and an outer cover 32. When these three parts are assembled together, the voids in them are combined to form a tube connecting the volume enclosed by the rear chamber 14 to the environment through an opening 34 in the side of the shell 15. A resistive port like the port 28 is, for example, a small opening in the wall of an acoustic chamber covered by a material providing an acoustical resistance, for example, a wire or fabric screen, that allows some air and acoustic energy to pass through the wall of the chamber. In the example of FIG. 8, the resistive port 28 formed by covering a hole in the spacer 30 with a resistive screen, and providing a path through the shell, to the environment, that does not provide any additional acoustic impedance.

SUMMARY

In general, in one aspect, a headphone includes an electroacoustic transducer, a shell enclosing a back side of the electroacoustic transducer to define a back cavity, a first opening, and a second opening through the shell, each opening coupling the back cavity to an outer surface of the shell, and a plate attached to the shell, the plate having a bottom surface abutting the outer surface of the shell, and a top surface opposite the bottom surface. The plate includes an exit cavity defined by side walls interior to the plate, an upper aperture in the top surface of the plate, and a lower aperture in the bottom surface of the plate, the lower aperture corresponding in dimension to the first opening through the shell and aligned with the first opening through the shell. A channel in the bottom surface of the plate begins at a point aligned with the second opening through the shell and ends at an aperture through one of the side walls of the exit cavity. The channel and the outer surface of the shell together form a reactive port from the back cavity to the exit cavity, the first opening through the shell forms a resistive acoustic port from the back cavity to the exit cavity, and the exit cavity couples the reactive port and the resistive acoustic port to free space without introducing additional acoustic impedance. In some examples, a water-resistant screen is located on the top surface of the plate and covers the upper aperture of the exit cavity. A set of headphones includes two such headphones.

Implementations may include one or more of the following. The water-resistant screen may be acoustically transparent. The water-resistant screen may have a specific acoustic resistance less than 10 Rayls (MKS). The water-resistant screen may be heat-staked to the top surface of the plate to seal the screen to the top surface around the upper aperture of the exit cavity. The water-resistant screen may comprise polyester fabric coated with a hydrophobic coating. An acoustically-resistive screen may cover the first opening through the shell on an inner surface of the shell and provide the acoustic resistance of the resistive port. The acoustically resistive screen may be water-resistant. The acoustically resistive screen may have a specific acoustic resistance of 260±15% Rayls (MKS). The acoustically resistive screen may be heat-staked to the inner surface of the shell to seal the screen to the inner surface around the first opening through the shell. The plate may be bonded to the shell by an ultrasonic weld. The ultrasonic weld may seal the plate to the shell to prevent sound and water from passing between the environment and first and second openings in through shell.

The first opening through the shell may be characterized by a first area, and the aperture of the channel forming the reactive port into the exit cavity may be characterized by a second area, the first area being at least four times greater than the second area. The first opening through the shell may have a first width in a side corresponding to the side of the exit cavity where the aperture of the channel forming the reactive port may be located, and the aperture of the channel forming the reactive port into the exit cavity may be generally semi-circular having a diameter, the width of the first opening being about two times the diameter of the aperture. The side wall of the exit cavity where the aperture of the channel forming the reactive port may be located may be a first side wall, the exit cavity may be characterized by a first cross-sectional area in a plane parallel to the first opening through the shell, a first width and a first depth at the first side wall, and a second depth at a side wall opposite the first side wall, the aperture of the channel forming the reactive port into the exit cavity may be characterized by a second area, the first width being greater than the first depth, the first depth being greater than the second depth, and the first cross-sectional area being at least four times greater than the second area. A second shell may enclose a front side of the electroacoustic transducer to define a front cavity, with a first opening through the second shell coupling the front cavity to an outer surface of the shell and a second water-resistant screen on an inner surface of the second shell covering the first opening through the second shell.

A third water-resistant screen may cover a second opening through the second shell coupling the front cavity to the outer surface of the shell; the first opening through the second shell forming a resistive acoustic port from the front cavity to free space, and the second opening through the shell providing an acoustic output from the headphone.

In general, in one aspect, assembling a headphone comprising an electroacoustic transducer, a shell, and a plate, includes coupling the shell to a back side of the electroacoustic transducer to form a back cavity, aligning an exit cavity in the plate, defined by side walls interior to the plate, an upper aperture in a top surface of the plate, and a lower aperture in a bottom surface of the plate opposite the top surface, with a first opening through the shell from the back cavity to an outer surface of the shell, the first opening corresponding in dimension to the lower aperture of the exit cavity, aligning a first end of a channel through a bottom surface of the plate with a second opening through the shell from the back cavity to the outer surface of the shell, a second end of the channel opening into the exit aperture, pressing the plate against the shell such that an energy director on the bottom surface of the plate is in contact with the outer surface of the shell, and applying ultrasonic energy to the plate, such that the energy director forms an ultrasonic weld between the plate and the shell. A water-resistant screen may be affixed on the top surface of the plate, covering the upper aperture of the exit cavity.

Implementations may include one or more of the following. The water-resistant screen may be acoustically transparent. Affixing the screen may include heat-staking the screen to the top surface of the plate to seal the screen to the top surface around the upper aperture of the exit cavity. An acoustically resistive screen may be affixed to an inner surface of the shell, covering the first opening through the shell. Affixing the screen may comprise heat-staking the screen to the inner surface of the shell to seal the screen to the inner surface around the first opening through the shell. A water-resistant screen may be affixed over apertures in a second shell, and the second shell may be coupled to a front side of the electroacoustic transducer to form a front cavity.

Advantages include simplifying the mechanical construction of an in-ear headphone having parallel reactive and resistive acoustic ports, and waterproofing such a headphone to prevent water intrusion through those and other ports.

Other features and advantages will be apparent from the description and the claims.

DESCRIPTION

In the example discussed above, a reactive port exits a headphone through a hole in the side of the shell forming the outer casing of the headphone, while a resistive port exits in a separate location. The improvement discussed below involves forming the ports in a different manner that allows them to share an opening to the environment. The disclosed construction is easier to assemble in general and it facilitates providing the additional feature of protecting the headphone against water intrusion through the ports.

Figure 1:
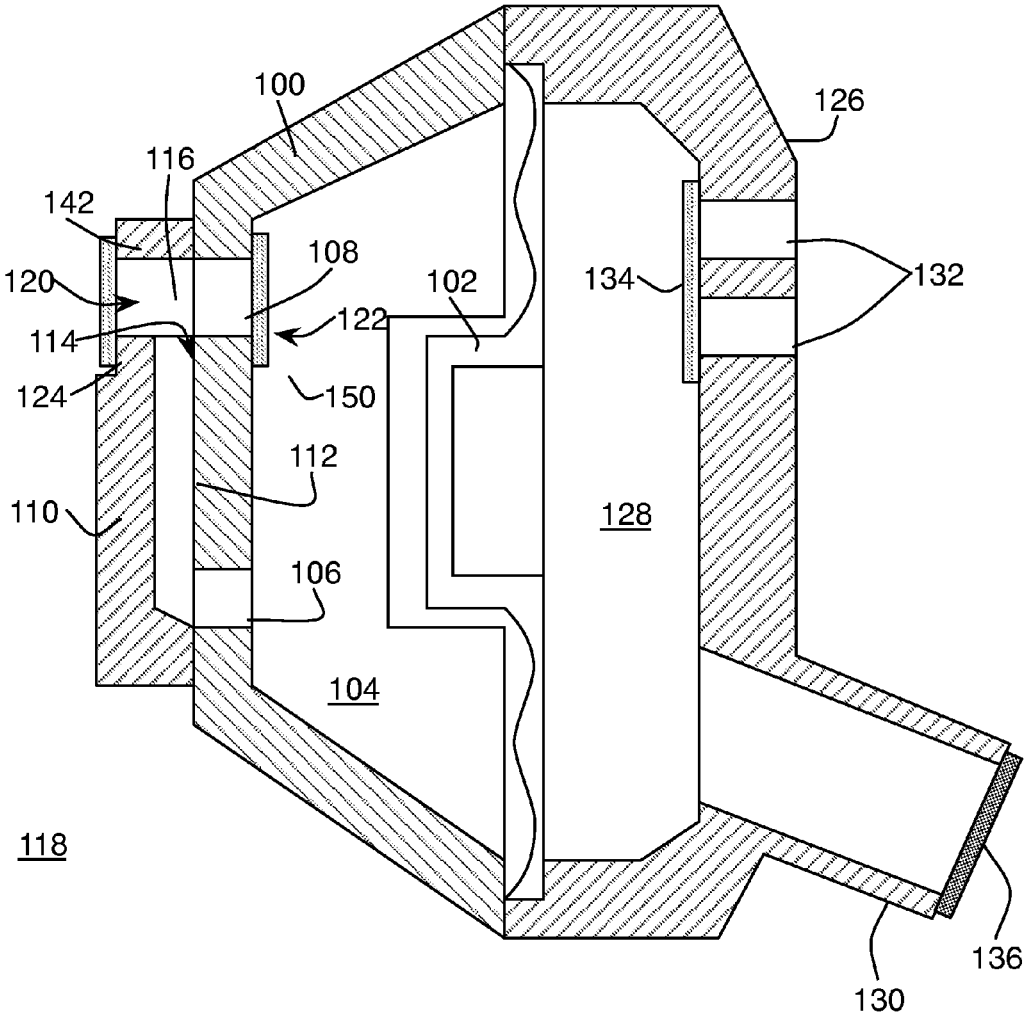
FIG. 1 shows a conceptual cross section of an in-ear headphone.

As shown in FIG. 1, an upper shell 100 generally encloses the back side of a transducer 102, forming a rear cavity 104. The upper shell 100 has two openings 106 and 108 above the transducer. A port plate 110 is seated on top of the upper shell. The port plate 110 includes a half-tube 112 that forms the reactive port when the port plate 110 is mated to the upper shell 100, closing the side of the half-tube. A more detailed embodiment of the port plate and half-tube can be seen in FIG. 2, discussed in more detail below. The first end of the half-tube 112 is aligned with the opening 106 in the upper shell, and the half-tube ends at a cutout 114 into a sidewall of an exit chamber 116. The exit chamber has a lower aperture 120 that aligns with the second opening 108 in the upper shell, and is open to the environment 118 through an upper aperture 122. The resistive port is formed by placing a resistive cloth 150 over the opening 108, inside the rear cavity 104. The exit chamber 116 and the external aperture 122 are sized to couple both the reactive port opening 114 and the resistive port formed at opening 108 to the environment 118 without imposing any additional acoustic impedance. Finally, a shelf 142 around the aperture 122 provides an attachment point for a water-resistant screen 124, which prevents water intrusion from the environment through either of the ports.

The headphone also includes a lower shell 126 which encloses the front side of the transducer to form a front cavity 128. In some examples, the front shell is open to the user's ear canal through a nozzle 130; in other examples, the front shell is open to the ear through conventional holes in the shell, not shown. In some examples, as described in U.S. patent application Ser. No. 12/857,462, additional ports 132 are provided in the front shell to control the acoustic response of the headphone. To provide water resistance for the front cavity, the opening of the nozzle and the additional ports are also covered with water resistant screens 134, 136.

Figure 2A:
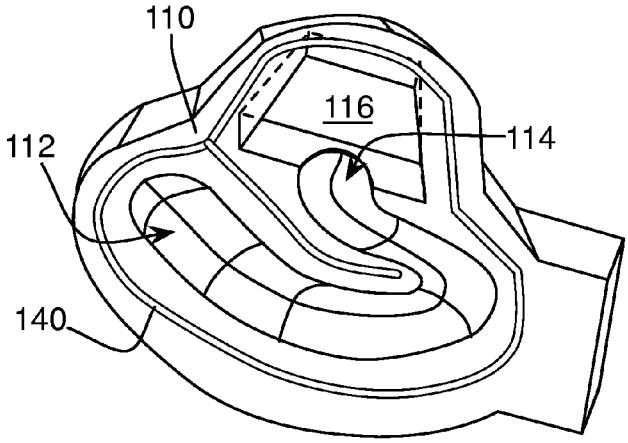
FIG. 2A shows an under-side perspective view of a port plate of an in-ear headphone.
Figure 2B:
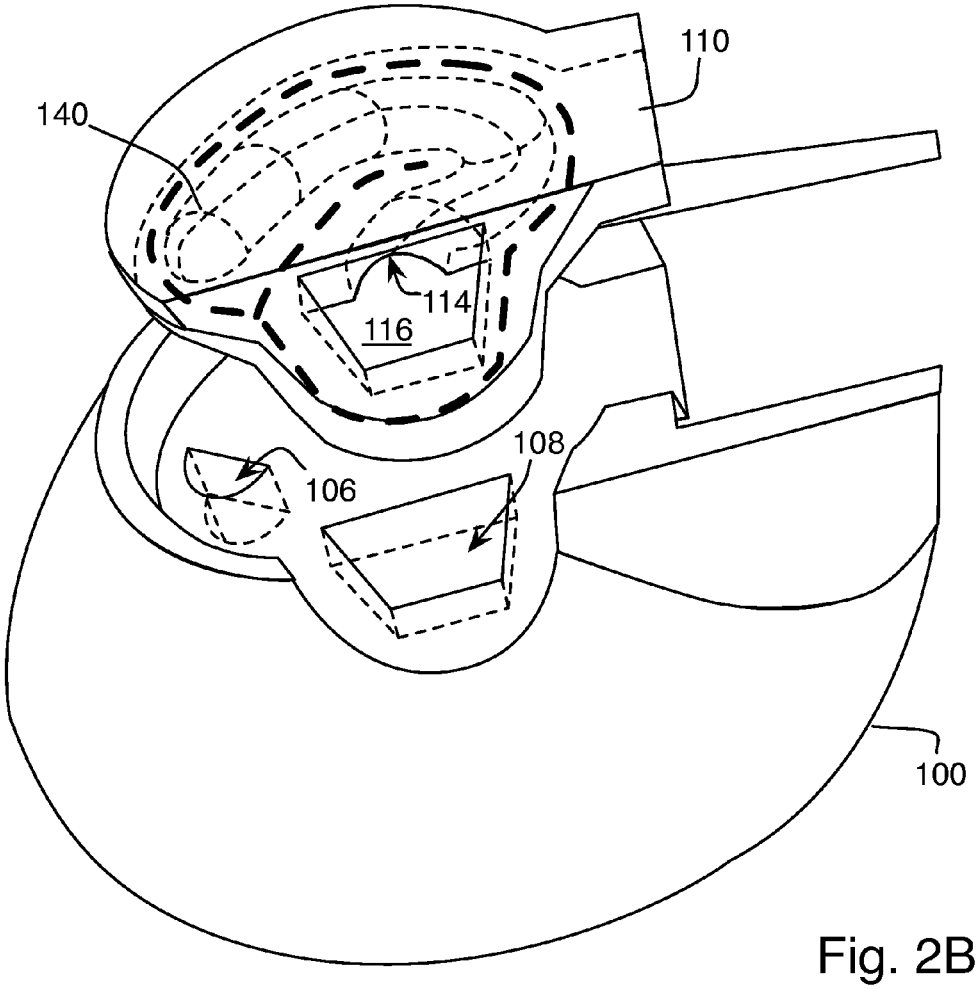
FIG. 2B shows an exploded view of the port plate and an outer shell of the in-ear headphone of FIG. 2A.

In some examples, as shown in FIGS. 2A and 2B, the port plate 110 is attached to the upper shell 100 by ultrasonic welding. FIG. 2A shows the underside of the port plate 110, while FIG. 2B shows the port plate 110 from above and partially removed from the upper shell 100. An energy director 140 (i.e., a raised ridge) on the bottom surface of the port plate surrounds the perimeter of the port plate 110 and extends to the inside of a fold in the half tube 112. The port plate is seated on the upper shell, with the exit chamber 116 aligned with the resistive port opening 108 and the entrance to the half-tube 112 aligned with the reactive port opening 106. When the port plate is in position, ultrasonic energy is applied, which turns the energy director into a weld between the port plate and the upper shell. Ultrasonic welding forms a physical seal around the half-tube 112 and around the exit chamber 116. This assures that the reactive port is acoustically sealed from the environment, except through its own exit 114. The seal formed by ultrasonic welding also prevents water intrusion into the half-tube 112 through potential gaps between the port plate and the upper shell. In combination with the water resistant screen 124, this construction protects the rear cavity (and the electroacoustic transducer contained within it) from entry of water, up to the actual water resistance of the screen.

Figure 3:
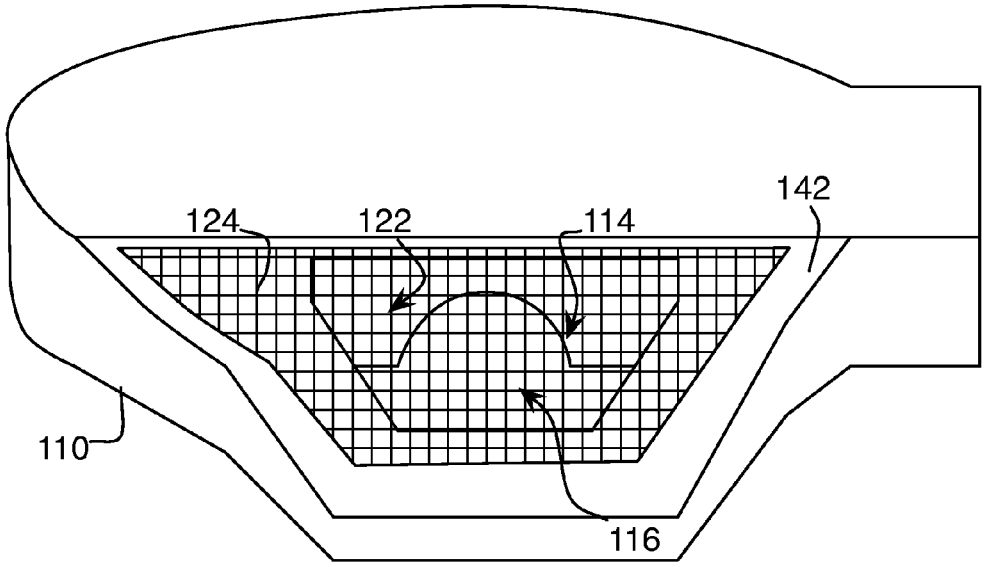
FIG. 3 shows a perspective view of the port plate of FIG. 2A and a screen.

FIG. 3 shows the attachment of the water resistant screen 124 to the port plate 110. As noted above, the port plate is configured with the shelf 142 surrounding the aperture 122. The screen 124 is placed over the aperture 122 and heat staked to the shelf 142, affixing it in place over the exit chamber 116 and forming a seal against water intrusion between the screen and the shelf. In some examples, the water resistant screen 124 is a polyester fabric with a hydrophobic coating, such as Hyphobe Acoustex fabric from SaatiTech of Somers, N.Y. The fabric for the screen is water resistant yet acoustically transparent, so it does not impose additional acoustic impedance to either the reactive or the resistive ports opening into the exit chamber 116. By "acoustically transparent," we refer to a screen having such low acoustic resistance that it's effect on the acoustic response of the headphone is negligible. In some examples, a screen having a specific acoustic resistance of less than 10 Rayls (measured using MKS units) can be regarded as acoustically transparent.

Figure 5:
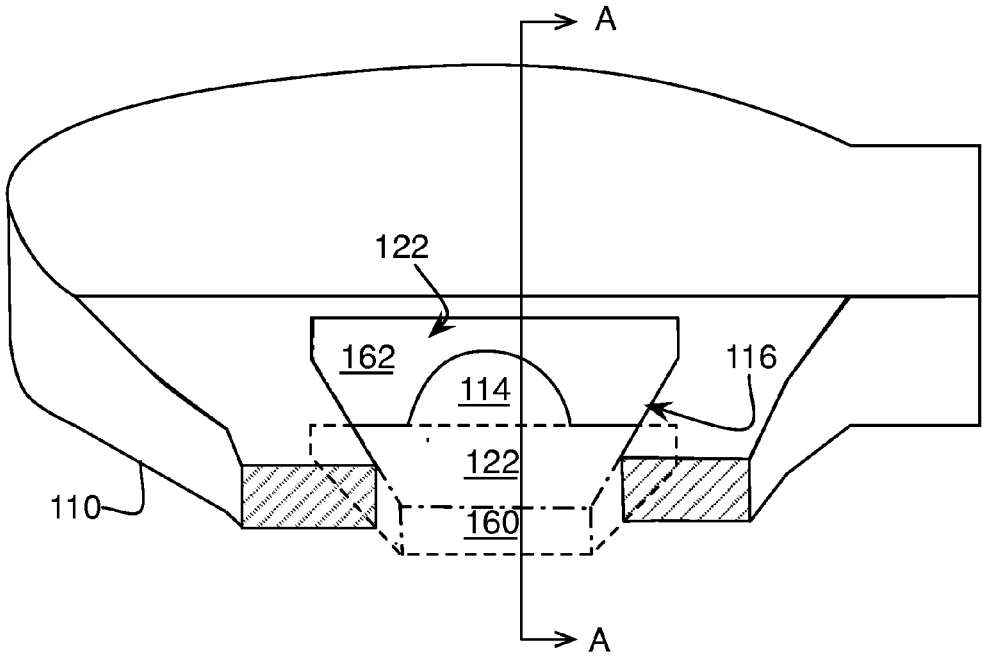
FIG. 5 shows a cut-away perspective view of the port plate of FIG. 2A.
Figure 4A:
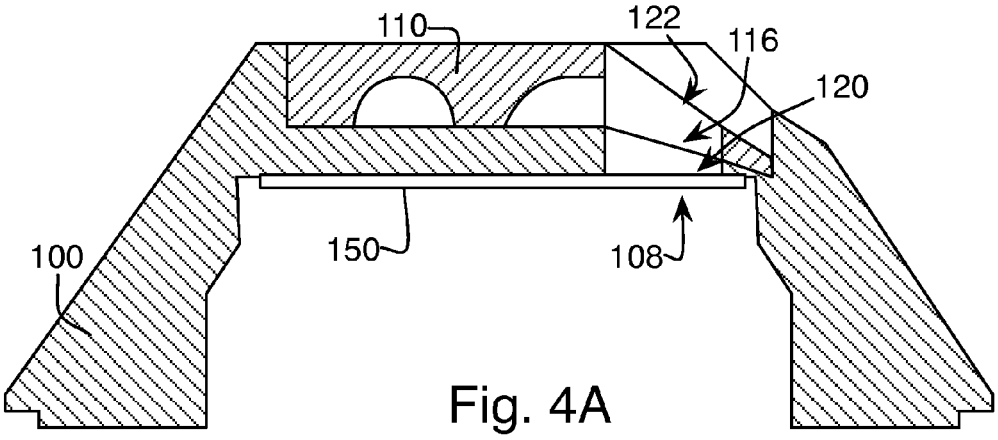
FIG. 4A shows a side sectional view of the port plate and outer shell of FIG. 2B as assembled.
Figure 4B:
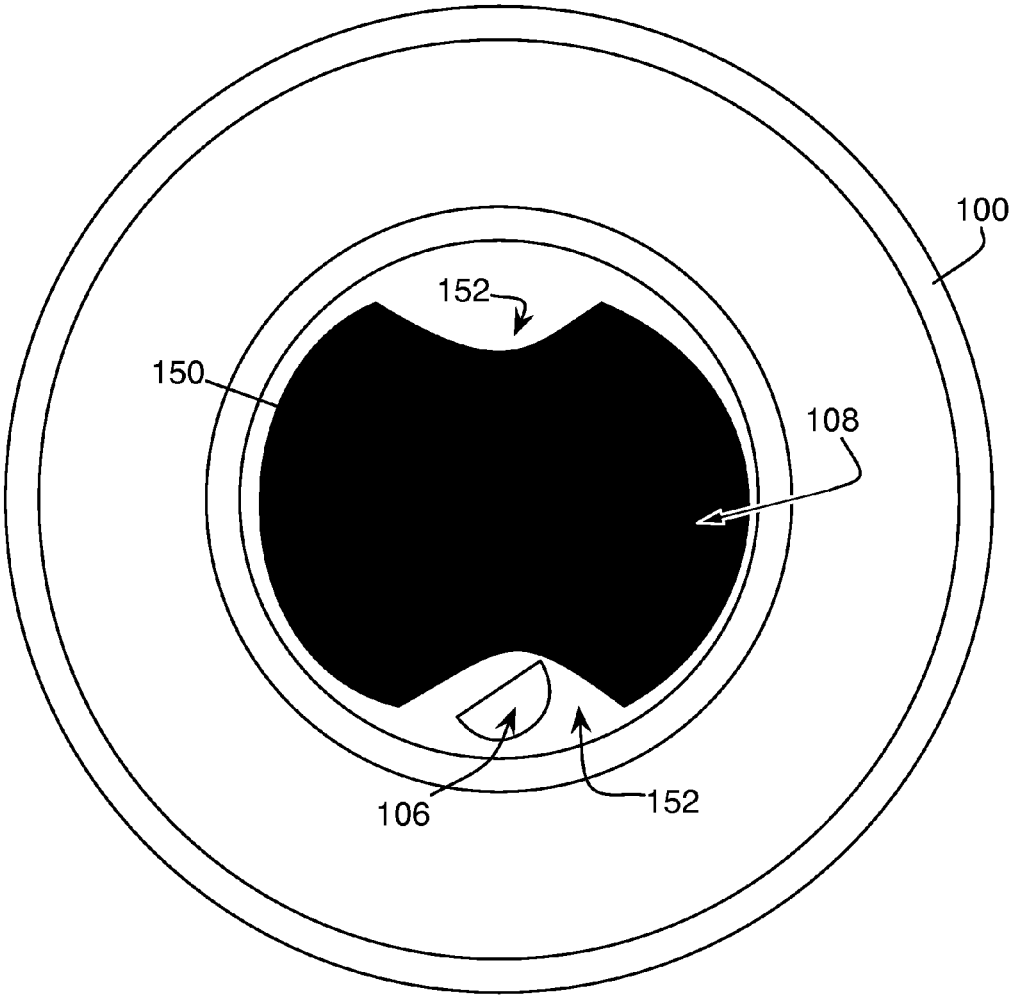
FIG. 4B shows an underside view of the outer shell of FIG. 2B and a screen.

The resistive port is formed by attaching a screen 150 having the desired specific acoustic resistance to the inside surface of the upper shell 100, covering the opening 108. In some examples, screen made of polyester fabric and having a specific acoustic resistance of 260±15% Rayls (MKS) is preferred. In some examples, as shown in FIGS. 4A and 4B, the screen 150 is sized to completely cover the underside of the top shell, with a space 152 cut out so that the screen 150 does not cover the opening 106 into the reactive port. In some examples, the space 152 is cut from both sides of the screen, so that the same part can be used in both right- and left-side headphones, as the reactive port hole 106 is on the opposite side between the two types. The screen is heat staked to the underside of the cap. In some examples, the cloth 150 providing the acoustic resistance is also water resistant, providing a second line of defense against water intruding through the resistive port opening. Poylester fabric providing a range of acoustic resistances and optional water resistance is available, for example from SaatiTech as noted above. The front cavity ports 132 and nozzle 130 are similarly covered (see FIG. 1) by heat staking screens that are water resistant and have the desired acoustic resistance for providing the desired acoustic response of the headphone to the plastic of the lower shell 126 and nozzle. In some examples, the front cavity ports are covered by screens having an acoustic resistance of 160±15% Rayls (MKS), and the nozzle is covered by a screen having an acoustic resistance of less than 10 Rayls (MKS), Also in FIG. 4A, one can see the exit chamber and surrounding components in cross-section. From this view, it can be seen that because the side walls of the resistive port opening 108 and exit chamber 116 are vertical, the apertures 120 and 122 of the exit chamber 116, and the cross-section of the chamber itself, match the resistive port opening 108 in dimension, when projected onto a plane perpendicular to the sidewalls of the resistive port opening 108 and exit chamber 116. It can also be seen that the length of the exit chamber 116 beyond the resistive port is much shorter than its width, thereby providing little additional acoustic impedance. As shown in FIG. 5, the wall 160 of the exit chamber 116 opposite the reactive port opening 114 is shorter and lower than the wall 162 hosting that opening, so air exiting the reactive port generally has a straight path to the environment, which avoids imposing additional acoustic impedance on the reactive port.

Figure 6A:
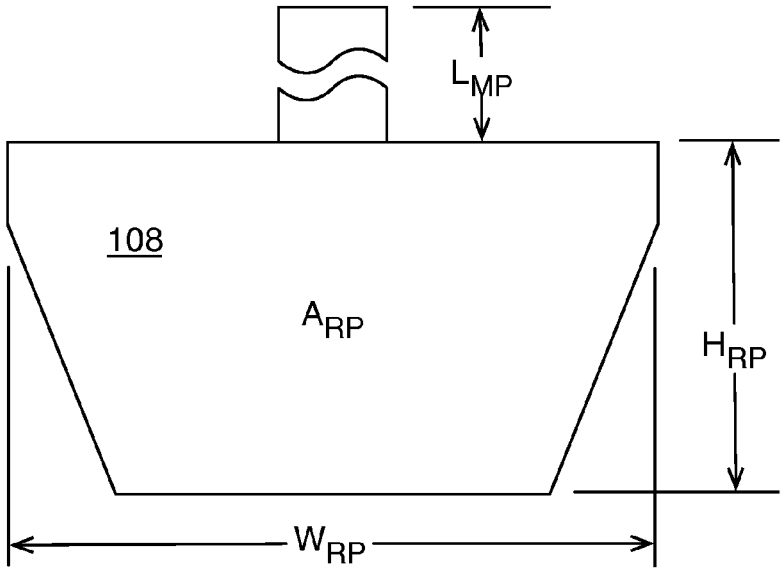
FIGS. 6A-6C show plan, front elevation, and side elevation views of cavities within the port plate and outer shell of FIG. 2B as assembled.
Figure 6B:
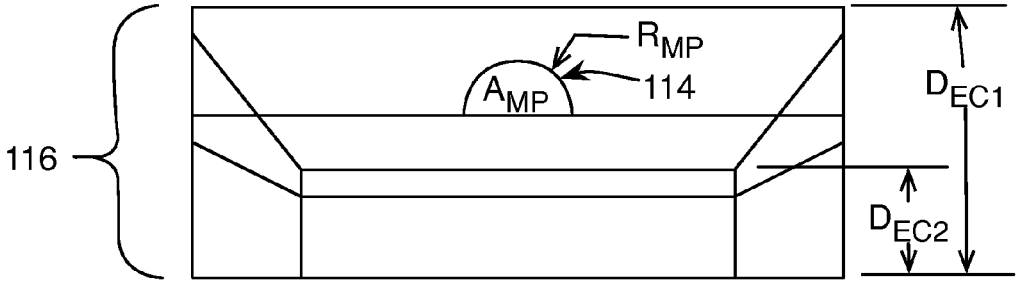
Figure 6C:
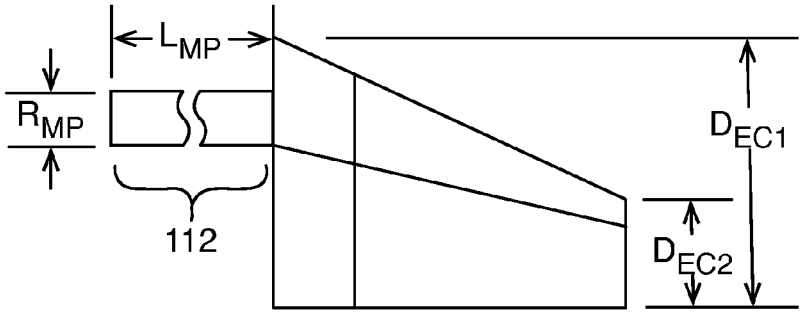
Figure 7:
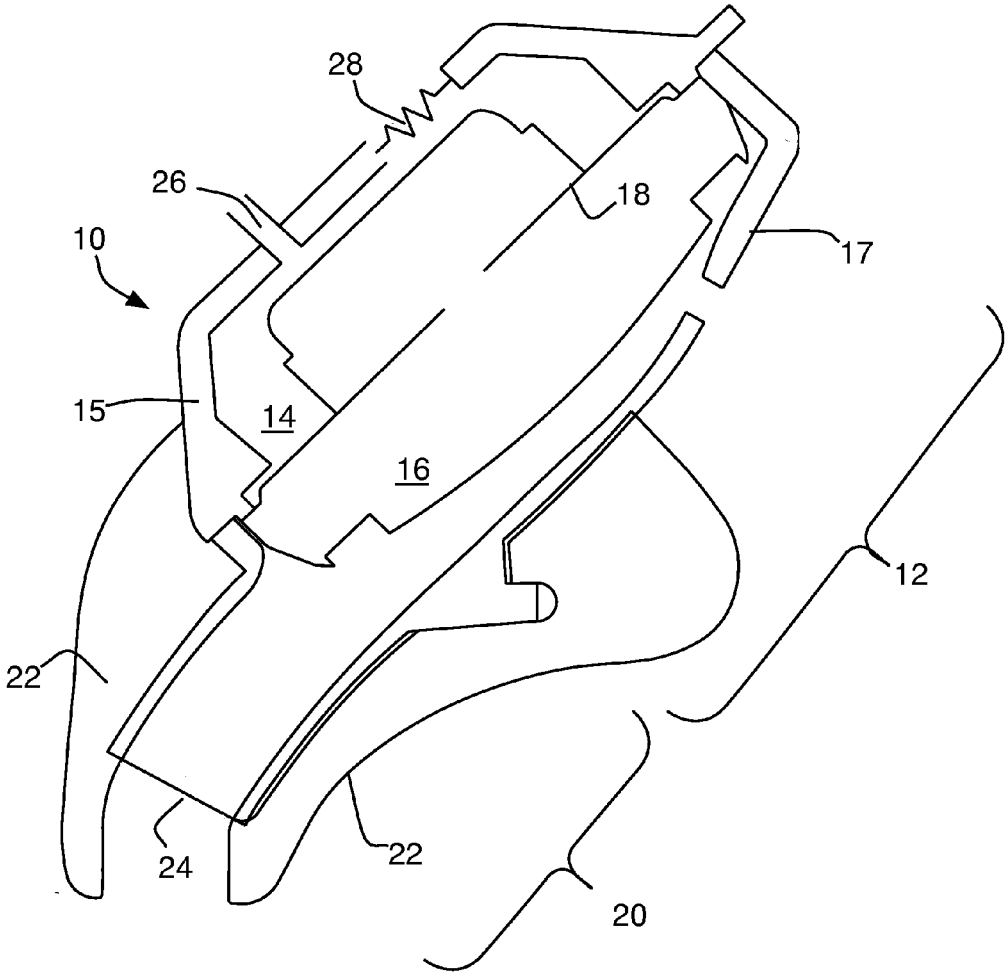
Fig. 7 (prior art)
FIG. 7 shows a schematic diagram of an in-ear headphone.
Figure 8:
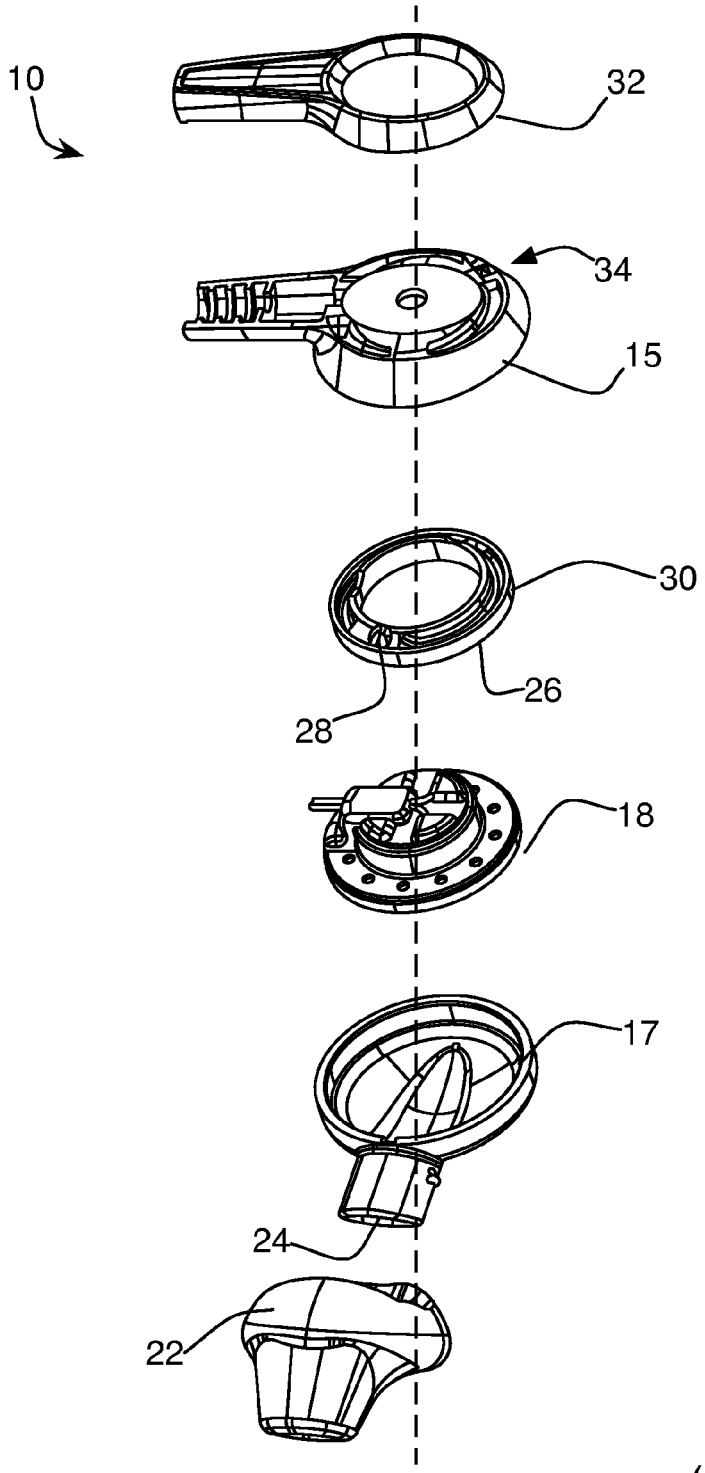
Fig. 8 (prior art)
FIG. 8 shows an exploded view of the components of an in-ear headphone.

In some examples, as shown in FIGS. 5 and 6A-6C, the sizes and positions of the port openings 114 and 108 are selected to not only provide the desired acoustic impedances, but also to avoid the two ports interacting, given their proximity to each other within the exit chamber 116. In FIG. 5, the end of the port plate 110 defining the exit cavity 116 is cut away to provide a better view of the lower aperture 122 (shown in dashed lines), reactive port opening 114, and the volume occupied by the exit chamber 116, shown in dashed-dotted lines in the cut-away portion. FIGS. 6A-6C show the boundaries of the exit chamber and mass port themselves. The lower aperture 120 of the exit chamber is coextensive with the top of the resistive port opening 108. In some examples, the resistive port and the exit chamber have a cross-sectional area ARP of around 5 $mm^2$. In the particular example shown, the resistive port and exit chamber are generally trapezoidal in plan view (FIG. 6A), to fit within the generally circular shape of the headphone (see FIG. 2B). In that example, the resistive port has a width WRP of about 3.5 mm at the long side and a height HRP of about 1.6 mm. The particular shape of the resistive port and exit chamber are not important, as long as the total area provides the desired acoustic resistance (when covered by the resistive cloth inside the back cavity), and the side adjacent to the reactive port is significantly wider than the reactive port exit, to avoid the sides of the exit chamber adding acoustic impedance to the reactive port exit.

Locating the reactive port exit 114 on the side of the exit chamber 116, perpendicular to the resistive port 108, helps avoid interactions between the two ports. In some examples, the mass port exit (and the mass port throughout its length) is a semi-circle with a radius $R_{MP}$ of less than 1 mm and a cross-sectional area $A_{MP}$ of a little over 1 $mm^2$; in such examples, the port may have a total length $L_{MP}$ of 11-12 mm. Also, as noted, the exit chamber 116 is sized to avoid adding any additional acoustic impedance to the ports. The depth of the exit chamber is determined by the thicknesses of the back cover 100 (not shown in FIG. 5) and the port plate 110 at the location of the exit chamber, with the resistive port itself being a zero-length opening at the bottom of the exit chamber. As shown in FIGS. 5, 6B and 6C, the back shell 100 and port plate 110 are tapered at the location of the exit chamber to minimize the depth of the exit chamber and to position the far wall 160 of the exit chamber so that it does not block the reactive port exit 114. In some examples, the exit chamber is less than 3 mm deep at the deeper side ($D_{EC1}$, face 162 in FIG. 5), and less than 2 mm deep at the shorter side ($D_{EC2}$, face 160 in FIG. 5).

In general, the area of the resistive port is about four times greater than the area of the reactive port, and the side of the exit chamber and resistive port where the reactive port enters the exit chamber is about twice as wide as the diameter of the semi-circular reactive port. In addition, the exit chamber is wider than it is deep at the deeper side. In one particular example, the reactive port opening 114 is a semi-circle with radius of 0.85 mm for an area of 1.135 $mm^2$, the resistive port opening 108 is 3.623 mm wide at the side corresponding to the reactive port exit with a total area of 5.018 $mm^2$, and the exit chamber is 2.698 mm deep at the deeper side 162 and 1.731 mm deep on the shorter side 160.

Other implementations are within the scope of the following claims and other claims to which the applicant may be entitled.

What is claimed is:

1. A headphone comprising:

an electroacoustic transducer;

a shell enclosing a back side of the electroacoustic transducer to define a back cavity, a first opening and a second opening through the shell each coupling the back cavity to an outer surface of the shell; and a plate attached to the shell, the plate having a bottom surface abutting the outer surface of the shell, and a top surface opposite the bottom surface, wherein the plate includes:

an exit cavity defined by side walls interior to the plate, an upper aperture in the top surface of the plate, and a lower aperture in the bottom surface of the plate, the lower aperture corresponding in dimension to the first opening through the shell and aligned with the first opening through the shell, and a channel forming a half-tube in the bottom surface of the plate; wherein the half-tube begins at a point aligned with the second opening through the shell and ends at an aperture through one of the side walls of the exit cavity;

the channel and the outer surface of the shell together form a reactive acoustic port from the back cavity to the exit cavity, the first opening through the shell forms a resistive acoustic port from the back cavity to the exit cavity, and the exit cavity couples the reactive acoustic port and the resistive acoustic port to free space without introducing additional acoustic impedance.

2. The headphone of claim 1, further comprising a water-resistant screen on the top surface of the plate and covering the upper aperture of the exit cavity.

3. The headphone of claim 2, wherein the water-resistant screen is acoustically transparent.

4. The headphone of claim 2, wherein the water-resistant screen has a specific acoustic resistance less than 10 Rayls (MKS).

5. The headphone of claim 2, wherein the water-resistant screen is heat-staked to the top surface of the plate to seal the screen to the top surface around the upper aperture of the exit cavity.

6. The headphone of claim 2, wherein the water-resistant screen comprises polyester fabric coated with a hydrophobic coating.

7. The headphone of claim 1, further comprising an acoustically-resistive screen covering the first opening through the shell on an inner surface of the shell and providing the acoustic resistance of the resistive port.

8. The headphone of claim 7, wherein the acoustically resistive screen is water-resistant.

9. The headphone of claim 7, wherein the acoustically resistive screen has a specific acoustic resistance of 260±15% Rayls (MKS).

10. The headphone of claim 7, wherein the acoustically resistive screen is heat-staked to the inner surface of the shell to seal the screen to the inner surface around the first opening through the shell.

11. The headphone of claim 1, wherein the plate is bonded to the shell by an ultrasonic weld.

12. The headphone of claim 11, wherein the ultrasonic weld seals the plate to the shell to prevent sound and water from passing between the environment and first and second openings in through shell.

13. The headphone of claim 1, wherein:

the first opening through the shell is characterized by a first area, and the aperture of the channel forming the reactive acoustic port into the exit cavity is characterized by a second area, wherein the first area is at least four times greater than the second area.

14. The headphone of claim 1, wherein:

the first opening through the shell has a first width in a side corresponding to the side of the exit cavity where the aperture of the channel forming the reactive acoustic port is located, and the aperture of the channel forming the reactive acoustic port into the exit cavity is generally semi-circular having a diameter, wherein the width of the first opening is about two times the diameter of the aperture.

15. The headphone of claim 1, wherein:

the side wall of the exit cavity where the aperture of the channel forming the reactive port is located is a first side wall, the exit cavity is characterized by a first cross-sectional area in a plane parallel to the first opening through the shell, a first width and a first depth at the first side wall, and a second depth at a side wall opposite the first side wall, the aperture of the channel forming the reactive acoustic port into the exit cavity is characterized by a second area, the first width is greater than the first depth, the first depth is greater than the second depth, and the first cross-sectional area is at least four times greater than the second area.

16. The headphone of claim 2, further comprising:

a second shell enclosing a front side of the electroacoustic transducer to define a front cavity, a first opening through the second shell coupling the front cavity to an outer surface of the shell; and a second water-resistant screen on an inner surface of the second shell and covering the first opening through the second shell.

17. The headphone of claim 16, further comprising:

a third water-resistant screen covering a second opening through the second shell coupling the front cavity to the outer surface of the shell;

wherein the first opening through the second shell forms a resistive acoustic port from the front cavity to free space, and the second opening through the shell provides an acoustic output from the headphone.

18. A method of assembling a headphone comprising an electroacoustic transducer, a shell, and a plate, the method comprising:

coupling the shell to a back side of the electroacoustic transducer to form a back cavity;

aligning an exit cavity in the plate, defined by side walls interior to the plate, an upper aperture in a top surface of the plate, and a lower aperture in a bottom surface of the plate opposite the top surface, with a first opening through the shell from the back cavity to an outer surface of the shell, the first opening corresponding in dimension to the lower aperture of the exit cavity;

aligning a first end of a channel which forms a half-tube through a bottom surface of the plate with a second opening through the shell from the back cavity to the outer surface of the shell, a second end of the half-tube channel opening into the exit aperture;

pressing the plate against the shell such that an energy director on the bottom surface of the plate is in contact with the outer surface of the shell; and applying ultrasonic energy to the plate, such that the energy director forms an ultrasonic weld between the plate and the shell.

19. The method of claim 18, further comprising affixing a water-resistant screen on the top surface of the plate, covering the upper aperture of the exit cavity.

20. The method of claim 19, wherein the water-resistant screen is acoustically transparent.

21. The method of claim 19, wherein affixing the screen comprises heat-staking the screen to the top surface of the plate to seal the screen to the top surface around the upper aperture of the exit cavity.

22. The method of claim 18, further comprising affixing an acoustically resistive screen to an inner surface of the shell, covering the first opening through the shell.

23. The method of claim 22, wherein affixing the screen comprises heat-staking the screen to the inner surface of the shell to seal the screen to the inner surface around the first opening through the shell.

24. The method of claim 18, further comprising:

affixing a water-resistant screen over apertures in a second shell; and coupling the second shell to a front side of the electroacoustic transducer to form a front cavity.

25. A set of headphones comprising a first and a second ear bud, each ear bud comprising:

an electroacoustic transducer;

a shell enclosing a back side of the electroacoustic transducer to define a back cavity, a first opening and a second opening through the shell each coupling the back cavity to an outer surface of the shell;

a plate attached to the shell, the plate having a bottom surface abutting the outer surface of the shell, and a top surface opposite the bottom surface, wherein the plate includes:

an exit cavity defined by side walls interior to the plate, an upper aperture in the top surface of the plate, and a lower aperture in the bottom surface of the plate, the lower aperture corresponding in dimension to the first opening through the shell and aligned with the first opening through the shell, and a channel forming a half-tube in the bottom surface of the plate; wherein the half-tube begins at a point aligned with the second opening through the shell and ends at an aperture through one of the side walls of the exit cavity; and a water-resistant screen on the top surface of the plate and covering the upper aperture of the exit cavity;

wherein, within each ear bud:

the channel and the outer surface of the shell together form a reactive acoustic port from the back cavity to the exit cavity, the first opening through the shell forms a resistive acoustic port from the back cavity to the exit cavity, and the exit cavity couples the reactive acoustic port and the resistive acoustic port to free space without introducing additional acoustic impedance.

* * * * *